US005841085A

United States Patent [19]

Rittinghaus et al.

[11] Patent Number: 5,841,085

[45] Date of Patent: Nov. 24, 1998

[54] PRESS-BUTTON SWITCHING DEVICE WITH SPRING-BIASED BRIDGE-FORMING CONTACT

[75] Inventors: Alfred Rittinghaus, Schalksmühle; Bernhard Jaworek, Hagen, both of Germany

[73] Assignee: Bär Elektrowerke GmbH & Co. KG, Schalksmühle, Germany

[21] Appl. No.: 843,697

[22] Filed: Apr. 16, 1997

[30] Foreign Application Priority Data

Apr. 19, 1996 [DE] Germany ..... 296 06 984 U

[51] Int. Cl.[6] ..... H01H 15/00; H01H 1/20; H01H 3/12; H01H 3/42

[52] U.S. Cl. ..... 200/16 R; 200/243; 200/277.1; 200/290; 200/524

[58] Field of Search ..... 200/16 R, 16 C, 200/240, 243, 531, 536, 260, 290, 277, 277.1, 524

[56] References Cited

U.S. PATENT DOCUMENTS 3,663,780 5/1972 Golbeck ..... 200/167
4,642,427 2/1987 Kratz et al. ..... 200/16 C
4,661,667 4/1987 Sorimachi et al. ..... 200/314
5,598,917 2/1997 Thomas ..... 200/548

*Primary Examiner*—Wynn Wood Coggins
*Assistant Examiner*—Michael J. Hayes
*Attorney, Agent, or Firm*—Friedrich Kueffner

[57] ABSTRACT

A press-button switching device includes a housing, stationary and movable contacts mounted in the housing, an actuating member constructed as a press-button which is guided during its switching movement in the interior of the housing and which moves the movable contacts into the respective switching positions thereof. A compression spring is arranged between the actuating member and the housing, wherein the actuating member is movable into the housing against the force of the spring. The movable contacts are each constructed as a bridge-forming contact which bridges two strip conductors in the switched-on position. During the inwardly and outwardly directed movements of the actuating member, the bridge-forming contact is moved along the strip conductors. At its end contacting the actuating member, the compression spring continues as a spring arm whose free end resiliently presses the bridge contact against the strip conductors.

11 Claims, 2 Drawing Sheets

PRESS-BUTTON SWITCHING DEVICE WITH SPRING-BIASED BRIDGE-FORMING CONTACT

BACKGROUND OF THE INVENTION

1. Field of the Invention

The present invention relates to a press-button switching device including a housing and stationary and movable contacts mounted in the housing. The device further includes an actuating member constructed as a press-button which is guided during its switching movement in the interior of the housing and which moves the movable contacts into the respective switching positions thereof. A compression spring is arranged between the actuating member and the housing, wherein the actuating member is movable into the housing against the force of the spring.

2. Description of the Related Art

Press-button switching devices of the above-described type are used in many instances. In a first embodiment of the device, the movable contact is rotated. All embodiments have in common that the devices are difficult to assemble because of the large number of components to be assembled.

SUMMARY OF THE INVENTION

Therefore, it is the primary object of the present invention to provide a press-button switching device of the above-described type which has as few components as possible, is easy to assemble and is safe in its operation.

In accordance with the present invention, the movable contacts are each constructed as a bridge-forming contact which bridges two strip conductors in the switched-on position. During the inwardly and outwardly directed movements of the actuating member, the bridge-forming contact is moved along the strip conductors. At its end contacting the actuating member, the compression spring continues as a spring arm whose free end resiliently presses the bridge contact against the strip conductors.

Due to the fact that the bridge-forming contact is moved simultaneously with the movement of the actuating member, a secure switching of the switching device is achieved. Thus, the bridge-forming contact is simultaneously pressed against the strip conductors by means of the existing compression spring, so that a secure current contact is achieved. Such a switching device can be easily assembled.

In accordance with an advantageous feature, the bridge-forming contact is constructed as a rolling contact, whose rollers are connected to each other through a shaft and contact the strip conductors. The rollers ensure that a secure contact exists between the rollers and the strip conductors, so that the rolling contact securely transmits current.

In accordance with a special embodiment of the present invention, the end of the compression spring resting on the bottom of the housing continues as an angular extension, wherein the free end of the extension engages into a control cam provided on the actuating member for adjusting the switching positions of the switching device. In this embodiment, it is ensured that a favorable configuration of the compression spring with the two extensions at the ends thereof produces a secure contact as well as a secure switching position. Since the compression spring proper is already made of spring material, this spring material can be used for achieving a resilient contact with the control cam.

In accordance with a recommended feature, the arm of the angle-shaped extension which rests against the end of the compression spring is arranged so as to rest over portions thereof on a projection, so that an additional pretensioning of the end of the angle-shaped extension into the control cam is achieved in this manner.

In order to achieve a secure support even when the actuating member is moved away from the angle-shaped arm, it is recommended to anchor the angle-shaped arm in the bottom of the device, so that a secure contacting is ensured while maintaining the spring action, without causing the arm to be raised from the bottom.

In accordance with an advantageous feature, the end of the extension engaging in the control cam is constructed as a bent piece of wire. In this manner, a secure contacting of the control cam is achieved because the engaging end has sufficient strength for contacting.

In accordance with a special embodiment of the invention, the strip conductors coming into contact with the bridge-forming contact are parts of a pressed screen which is arranged on a subsequently insertable housing wall, wherein bent portions of the pressed screen are constructed as connecting contacts.

The bridge-forming contact provided for connecting the strip conductors ensures that the device can be easily manufactured because, shortly before finishing the manufacture of the switch, the pressed screen is divided, so that the strip conductors arranged on the housing wall are ready to be used for the bridge-forming contact, wherein advantageously the support of the strip conductors can be effected at the housing wall by means of rivets or calks.

In accordance with an advantageous feature, for effecting the fastening, the housing wall supporting the strip conductors is provided with a projection which engages behind a portion of the remaining switch housing.

In accordance with a special embodiment of the invention, the anchoring member engages over the arm of the compression spring in order to ensure the exact switching position. This engagement produces a precise positioning of the compression spring arm, on the one hand, and, on the other hand, the correct projection of the arm end is provided for engagement in the control cam.

In accordance with an advantageous feature, the pressed screen with specially configured ends as plug-in contacts can be replaced easily and without difficult assembly by a punched screen with ends constructed as printed contacts, so that the connections of the switching device and the use of the switching device can be modified easily.

In accordance with a recommended feature, the preassembled switch housings with spring, contact roller and plunger, can be converted only in the last work step into switches either with plug-in contacts or print contacts.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
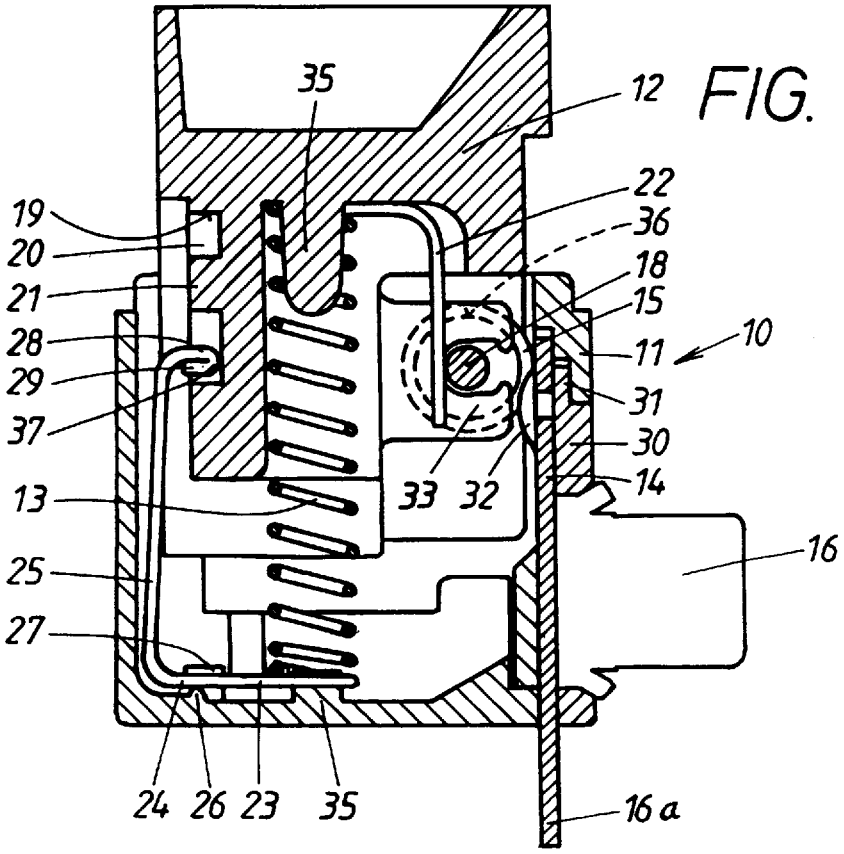
FIG. 1 is a sectional view of a press-button switching device according to the present invention.

The press-button switching device illustrated in the drawing is constructed as a push or press switch 10. The switch 10 is composed of a housing 11 and a key-like actuating member 12. The key-like actuating member 12 is movably mounted in the housing 11. A compression spring 13 is provided between the actuating member 12 and the bottom of the housing 11. The compression spring 13 is arranged in such a way that it has the tendency to press the actuating member 12 out of the switch housing 11. As illustrated in FIG. 1, the two ends of the compression spring are held by means of projections 35. These projections 35 make it possible that the spring 13 is securely mounted in the housing.

The end of the compression spring 13 acting on the actuating member 12 is provide with a resilient arm 22. The extent of the resiliency of the arm 22 depends on how tightly the spring end is mounted on the projection 35.

The end of the compression spring 13 resting on the bottom is provided with an extension 23. This extension 23 is angle-shaped.

Stationary contacts 14 constructed as strip conductors are mounted in the interior of the housing 11. These stationary contacts are bridged by means of movable contacts 15. The movable contacts are each constructed as a so-called bridge-forming contact which includes a pair of rollers 17 which roll on the strip conductors 14. The two rollers 17 are connected to each other through a shaft 18. It must be mentioned in this connection that the rollers 17 each have a step 36. Together with ramps 32 provided on the housing wall 30, these steps cause the bridge-forming contact 15 to be lifted from the strip conductors 14 when the actuating member is moved.

It should further be mentioned that the resilient arm 22 acts on the shaft 18 of the bridge-forming contact 15 and applies a load on the pair of rollers 17 or the bridge-forming contact 15 in such a way that the latter resiliently rests against the strip conductors 14.

Figure 2:
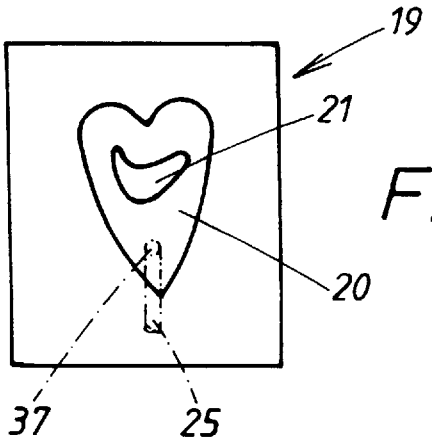
FIG. 2 is a schematic illustration of a control cam for the press-button switching device.

A control cam 19 is provided for adjusting the switching positions of the switching device. This control cam 19 is illustrated in detail in FIG. 2. The control cam 19 is formed by a heart-shaped recess 20 with a kidney-shaped protrusion 21 being formed in the middle of the recess 20. A control part 37 engages in the heart-shaped cam. In FIG. 1, the switch is in a pressed-out position. The control part 37, indicated by a circle in FIG. 2, is located underneath the kidney-shaped protrusion 21. During a downward movement of the actuating member 12 as shown in the drawing, the control part 37 slides against the kidney-shaped protrusion 21 and then further along the side wall of the heart-shaped cam until the control part 37 finally stops above the protrusion 21 and rests against this protrusion 21. Since the control part rests on the protrusion, the actuating member cannot be pressed out of the housing. When the actuating member is once again pushed in, the control part finally slides past the kidney-shaped protrusion and returns into the position shown in FIG. 2. The actuating member is then again in its position in which it protrudes out of the housing.

The control part 37 is constructed as an end 28 of the angle-shaped extension 23.

The extension 23 is formed by an arm 24 as well as an arm 25. The arm 24 rests on a projection 26 on the bottom of the housing 11 and is resiliently pretensioned by the projection 35. Also provided in this area is an anchoring member 27 which securely a portion of the arm 24, so that the arm 24 is secured in a pretensioned manner by means of the compression spring end at the projection 35 and also by the anchoring member 27, wherein the anchoring member 27 projects beyond the arm 24 and acts to secure the switched-on position. The arm 24 continues as the arm 25 which essentially extends in the direction of movement of the actuating member 12. The free end 28 of this arm 25 is provided with a bent portion 29, wherein this bent portion 29 forms the control part engaging in the control cam 19.

The strip conductors 14 are arranged on a housing wall 30. This housing wall 30 has a projection 31 which engages with portions thereof behind the housing 11 of the press switch, as shown in FIG. 1, so that this end of the housing wall is already secured to the switch housing. The lower end of the wall can be secured by a glued connection or a locking connection, not shown.

The strip conductors extend in the form of connecting contacts 16 through the housing wall. However, as also indicated in FIG. 1, the strip conductors may extend through the bottom of the housing 11.

Figure 3:
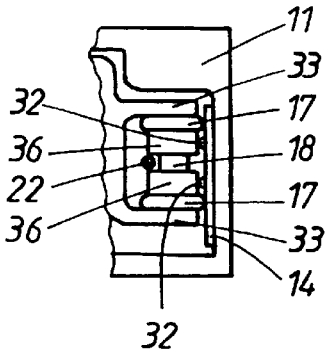
FIG. 3 is a top view of the bridge-forming contact of the device.

As illustrated in FIG. 3, the pair of rollers 17 are held by means of a clamp 33. The clamp 33 is provided at both ends of the shaft 18. This engagement of the clamp can also be seen in FIG. 1. However, in that case, the spacing between the portions of the clamp engaging the shaft is significantly narrower, so that the rollers are provided at the outer sides of the clamp. The shaft 18 is mounted within the clamp, so that the rollers are forced by the spring arm 22 in the direction toward the strip conductors.

Figure 4:
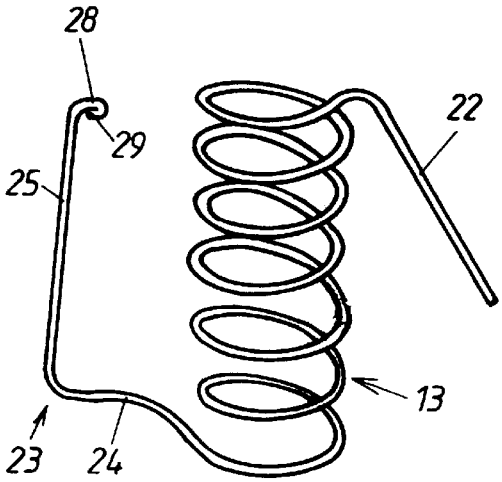
FIG. 4 is a perspective view of the compression spring of the press-button switching device.

FIG. 4 shows the compression spring 13 with its arm 22 and its angle-shaped extension 23. The entire spring component is made of a spring steel in order to be able to utilize the resilient properties of the compression spring and the parts connected thereto.

Figure 5:
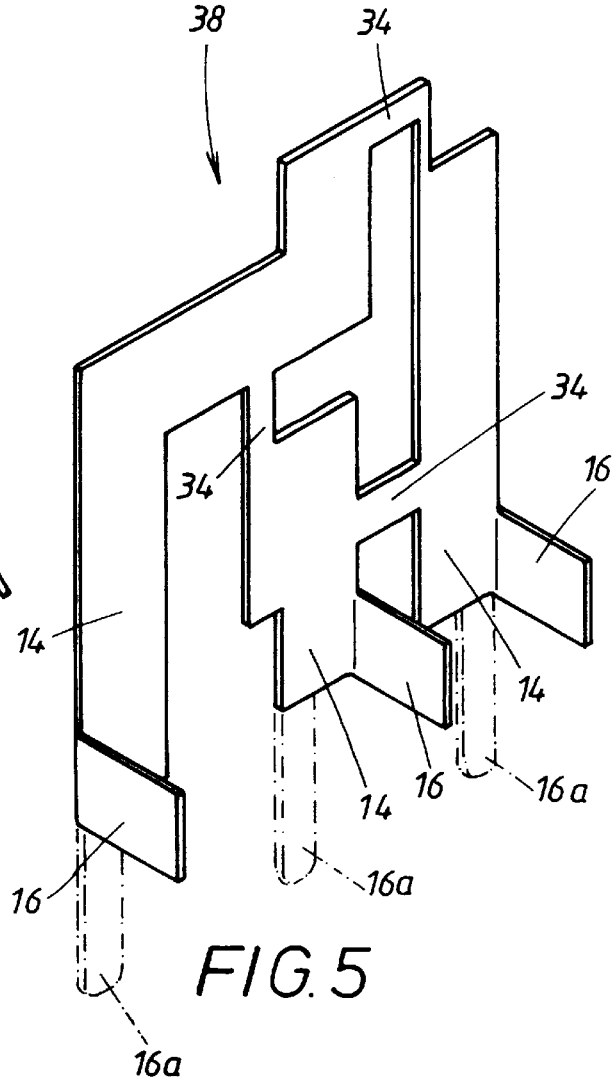
FIG. 5 is a perspective view of a pressed screen.

As shown in FIG. 5, the strip conductors are part of a pressed screen 38. The individual strip conductors are held together by means of connecting webs 34. In this embodiment, the connecting contacts are provided as simple bent-out portions of the strip conductors. The pressed screen 38 is fastened to the housing wall 30, wherein fastening is effected by means of bent portions which are shown in FIG. 1 but are not identified by a reference numeral. The housing wall 30 is a component which is subsequently insertable. The pressed screen 38 fastened to the housing wall 30 may be provided either with plug-in contacts 16*a*, as shown in FIG. 1, or with print contacts, as indicated by reference numeral 16 in FIGS. 1 and 5 of the drawing. Thus, the housing 30 with the pressed screen 38 is insertable into the switching device in a last work step.

As already mentioned, the embodiments illustrated in the drawing are only examples of the manner in which the present invention can be realized. Rather, the present invention is not limited to these embodiments. Various changes and applications are possible.

Instead of the bent portion as a control part, it is also possible to provide a special sliding part on the spring end, wherein this sliding part would engage in the control cam. In a special embodiment, the free end of the spring arm could itself be constructed as a single piece to form a bridge-forming contact, in order to be able to contact the two strip conductors through a bent contact.

While specific embodiments of the invention have been shown and described in detail to illustrate the inventive principles, it will be understood that the invention may be embodied otherwise without departing from such principles.

We claim:

1. A press-button switching device comprising a housing and stationary contacts and movable contacts mounted in the housing, an actuating member constructed as a press-button guided in an interior of the housing during switching movements of the press-button, the press-button being configured to move the movable contacts in and out of the housing between a switched-on position and a switched-off position, a compression spring mounted between the actuating member and the housing, wherein the actuating member is moveable out of the housing and into the housing against a force of the spring, the moveable contacts being constructed as bridge-forming contacts for bridging two strip conductors in the switched-on position, wherein the bridge contact is moved along the strip conductors during the movement of the actuating member into and out of the housing, and wherein the compression spring comprises at one end thereof a spring arm contacting the actuating member, and wherein the compression spring has a free end which resiliently presses the bridge contact against the strip conductors.

2. The switching device according claim 1, wherein each bridge-forming contact comprises a rolling contact with rollers which contact the strip conductors, wherein the rollers are connected to each other through a shaft.

3. The switching device according to claim 1, wherein the housing has a bottom, an end of the compression spring resting against the bottom of the housing, the end of the compression spring resting against the housing comprising an extension having a free end, further comprising a control cam for adjusting the switching device mounted on the actuating member, wherein the free end of the extension engages in the control cam.

4. The switching device according to claim 3, wherein the extension of the compression spring is angle-shaped with an arm, the bottom of the housing having a projection, wherein the arm of the extension rests with portions thereof on the projection.

5. The switching device according to claim 4, wherein the arm is over a portion thereof anchored to the housing.

6. The switching device according to claim 3, wherein the free end of the extension engaging the control cam is a bent wire portion.

7. The switching device according to claim 1, wherein the strip conductors contacting the bridge-forming contact are parts of a pressed screen arranged on a subsequently insertable housing wall, wherein bent portions of the pressed screen are constructed as connecting contacts.

8. The switching device according to claim 7, wherein the housing wall supporting the strip conductors comprises a projection engaging a portion of the housing.

9. The switching device according to claim 4, wherein the bottom of the housing comprises an anchoring member, and wherein the anchoring member engages over the arm of the compression spring for securing an exact switching position.

10. The switching device according to claim 7, wherein the pressed screen is a removable part which is replaceable by a pressed screen with ends comprising ends constructed as print contacts.

11. The switching device according to claim 10, wherein the housing with the compression spring, the bridge-forming contacts and the actuating member form a preassembled unit, wherein the pressed screen provided with one of plug-in contacts and print contacts is insertable into the switching device in a last work step.

* * * * *